United States Patent [19]

Chapman et al.

[11] Patent Number: 4,885,272

[45] Date of Patent: Dec. 5, 1989

[54] THIADIAZOLYL-AZO-PYRAZOLE YELLOW DYE-DONOR ELEMENT FOR THERMAL DYE TRANSFER

[75] Inventors: Derek D. Chapman, Rochester; Helmut Weber, Webster, both of N.Y.

[73] Assignee: Eastman Kodak Company, Rochester, N.Y.

[21] Appl. No.: 316,273

[22] Filed: Feb. 27, 1989

Related U.S. Application Data

[63] Continuation-in-part of Ser. No. 190,924, May 6, 1988, abandoned.

[51] Int. Cl.[4] ..... B41M 5/035; B41M 5/26

[52] U.S. Cl. ..... 503/227; 8/471; 418/195; 418/480; 418/913; 418/914

[58] Field of Search ..... 8/471; 428/195, 480, 428/913, 914; 503/227

[56] References Cited

U.S. PATENT DOCUMENTS 4,698,651 10/1987 Moore et al. ..... 503/227

FOREIGN PATENT DOCUMENTS 60-30392 2/1985 Japan ..... 503/227

1029747 5/1966 United Kingdom ..... 8/662

*Primary Examiner*—Bruce H. Hess

*Attorney, Agent, or Firm*—Harold E. Cole

[57] ABSTRACT

A yellow dye-donor element for thermal dye transfer comprises a support having thereon a dye dispersed in a polymeric binder, the dye having the formula:

or wherein each $R^1$ independently represents hydrogen, a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ and $R^4$ each independently represents $R^1$, with the proviso that at least one of $R^3$ and $R^4$ is hydrogen;

$R^5$ represents hydrogen; halogen; cyano; a substituted or unsubstituted alkyl, alkylthio, alkylsulfonyl, alkylsulfinyl, alkoxycarbonyl, carbamoyl or alkoxy group having from 1 to about 10 carbon atoms; a substituted or unsubstituted arylthio, arylsulfonyl, arylsulfinyl, aryloxy or aryl group having from about 6 to about 10 carbon atoms; or a substituted or unsubstituted acylamido group having from about 1 to about 7 carbon atoms; and $R^6$ represents hydrogen; halogen; cyano; alkoxy; a substituted or unsubstituted alkyl group having from 1 to about 10 carbon atoms; a cycloalkyl group having from about 5 to about 7 carbon atoms or an aryl group having from about 6 to about 10 carbon atoms.

18 Claims, No Drawings

THIADIAZOLYL-AZO-PYRAZOLE YELLOW DYE-DONOR ELEMENT FOR THERMAL DYE TRANSFER

This application is a continuation-in-part of U.S. application Ser. No. 190,924, filed May 6, 1988 now abandoned.

This invention relates to dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have good light stability and have improved hues.

British Patent No. 1,029,747 relates to thiadiazole azo yellow dyes similar to those described herein used for textile dyeing. There is no disclosure in this patent, however, that such dyes would be useful in a thermal transfer system.

JP 60/030,392 relates to dyes useful for thermal transfer systems. Those dyes are only somewhat similar to the dyes described herein, however, and are magenta instead of yellow as are the dyes of this invention.

Substantial improvements in light stability and hues are achieved in accordance with this invention which comprises a yellow dye-donor element for thermal dye transfer comprising a support having thereon a dye dispersed in a polymeric binder, the dye having the formula:

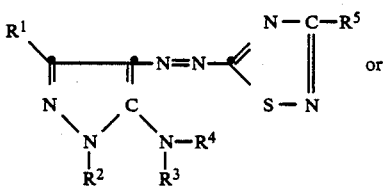

-continued

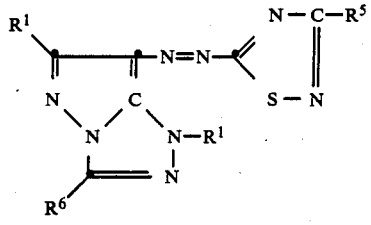

wherein each $R^1$ independently represents hydrogen, a substituted or unsubstituted alkyl group having from 1 to about 10 carbon atoms such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; or an aryl group having from about 6 to about 10 carbon atoms, such as phenyl, pyridyl, naphthyl, p-tolyl, p-chlorophenyl, or m-(N-methyl sulfamoyl)phenyl;

$R^2$ represents a substituted or unsubstituted alkyl group having from 1 to about 10 carbon atoms, such as those listed above for $R^1$; a cycloalkyl group having from about 5 to about 7 carbon atoms, such as those listed above for $R^1$; or an aryl group having from about 6 to about 10 carbon atoms, such as those listed above for $R^1$;

$R^3$ and $R^4$ each independently represents $R^1$, with the proviso that at least one of $R^3$ and $R^4$ is hydrogen;

$R^5$ represents hydrogen; halogen, such as chlorine, bromine, or fluorine; cyano; a substituted or unsubstituted alkyl, alkylthio, alkylsulfonyl, alkylsulfinyl, alkoxycarbonyl (such as ethoxycarbonyl or methoxyethoxycarbonyl), carbamoyl (such as N,N-dimethylcarbamoyl), or alkoxy group (such as methoxy, ethoxy, methoxyethoxy 2-cyanoethoxy) having from 1 to about 10 carbon atoms; a substituted or unsubstituted arylthio, arylsulfonyl, arylsulfinyl, aryloxy or aryl group having from about 5 to about 10 carbon atoms, such as phenylthio, p-toluenesulfonyl, 2-pyridylsulfinyl, m-chlorophenoxy, p-fluorophenyl, 3-pyridyl or 1-naphthyl; or a substituted or unsubstituted acylamido group having from about 1 to about 7 carbon atoms, such as acetamido, trifluoroacetamido, formamido, benzamido or methane sulfonamido; and $R^6$ represents hydrogen; halogen; cyano; alkoxy; a substituted or unsubstituted alkyl group having from 1 to about 10 carbon atoms, such as those listed above for $R^1$; a cycloalkyl group having from about 5 to about 7 carbon atoms, such as those listed above for $R^1$; or an aryl group having from about 6 to about 10 carbon atoms, such as those listed above for $R^1$.

In a preferred embodiment of the invention, $R^1$ in the above formula is hydrogen, methyl, ethyl, t-butyl, phenyl or benzyl. In another preferred embodiment, $R^2$ in the above formula is phenyl. In still another preferred embodiment, $R^3$ is hydrogen, methyl, butyl, phenyl or methoxyphenyl. In yet still another preferred embodiment, $R^4$ is hydrogen. In yet still another preferred embodiment, $R^5$ is hydrogen, phenyl or alkylthio. In still another preferred embodiment, $R^6$ is methyl, t-butyl or i-propyl.

Compounds included within the scope of the invention include the following:

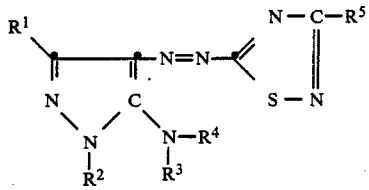

(I)

| Compound | $R^1$ | $R^2$ | $R^3$ | $R^4$ | $R^5$ |
|---|---|---|---|---|---|
| 1 | $-C(CH_3)_3$ | $C_6H_5$ | H | H | $SC_2H_5$ |
| 2 | $-C(CH_3)_3$ | $C_6H_5$ | H | H | $SCH_3$ |
| 3 | $C_6H_5$ | $C_6H_5$ | H | H | $SC_2H_5$ |
| 4 | $CH_3$ | $C_6H_5$ | $C_6H_4-o-OCH_3$ | H | $SC_2H_5$ |
| 5 | $CH_3$ | $C_6H_5$ | $C_6H_5$ | H | $SC_2H_5$ |
| 6 | $CH_3$ | $C_6H_5$ | $CH_3$ | H | $SC_2H_5$ |
| 7 | $CH_3$ | $C_6H_5$ | n-$C_4H_9$ | H | $SC_2H_5$ |
| 8 | $-C(CH_3)_3$ | $C_6H_5$ | H | H | $C_6H_5$ |
| 9 | $-C(CH_3)_3$ | $C_6H_5$ | H | H | H |
| 10 | $-CH(CH_3)_2$ | $C_6H_5$ | H | H | $SCH(CH_3)_2$ |
| 11 | $C_4H_9$ | $C_6H_5$ | H | H | $SCH_3$ |
| 12 | $C_4H_9$ | $C_6H_5$ | H | H | $SOCH_3$ |
| 13 | $C_3H_7$ | $C_6H_5$ | H | H | $SC_2H_5$ |
| 14 | $CH_3$ | $C_6H_5$ | H | $C_6H_5$ | $SC_2H_5$ |
| 15 | $C_2H_5$ | $C_2H_5$ | H | H | $SCH_2C_6H_5$ |
| 16 | $C_6H_5$ | $C_6H_5$ | H | H | Cl |
| 17 | $-C(CH_3)_3$ | $C_6H_5$ | H | $C_3H_7$ | $SO_2CF_3$ |
| 18 | $CH_3$ | $C_6H_5$ | H | H | $SOC_2F_5$ |
| 19 | $CF_3$ | $C_6H_5$ | H | H | $CO_2CH_3$ |
| 20 | $-C(CH_3)_3$ | $-C(CH_3)_3$ | H | H | $OC_6H_5$ |
| 21 | $CH_3$ | $C_6H_5$ | H | $CH_3$ | $CON(CH_3)_2$ |

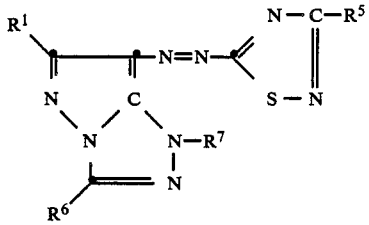

(II)

| Compound | $R^1$ | $R^6$ | $R^7$ | $R^5$ |
|---|---|---|---|---|
| 22 | $-C(CH_3)_3$ | $C_6H_4-o-OCH_3$ | $CH_3$ | $SC_2H_5$ |
| 23 | $C_4H_9-t$ | $C_4H_9-t$ | $CH_3$ | $SC_2H_5$ |
| 24 | $C_6H_5$ | $CH_3$ | $C_2H_5$ | $SC_2H_5$ |
| 25 | $C_6H_5$ | $C_4H_9-t$ | $C_2H_5$ | $SC_2H_5$ |
| 26 | $C_6H_5$ | $C_4H_9-t$ | $CH_3$ | $SC_2H_5$ |
| 27 | $CH_3$ | $C_3H_7-i$ | $CH_3$ | $SC_2H_5$ |
| 28 | $C_6H_5$ | $CH_3$ | $CH_3$ | $SC_2H_5$ |
| 29 | $CH_3$ | $C_4H_9-t$ | $CH_2C_6H_5$ | $SC_2H_5$ |
| 30 | $CH_3$ | $C_4H_9-t$ | $CH_3$ | H |
| 31 | $CH_3$ | $C_4H_9-t$ | $C_2H_5$ | $SC_2H_5$ |
| 32 | $CH_3$ | $C_3H_7-i$ | $C_2H_5$ | $SC_2H_5$ |
| 33 | $CH_3$ | $C_4H_9-t$ | H | $SC_2H_5$ |
| 34 | $CH_3$ | $CH_3$ | $C_2H_5$ | $SC_2H_5$ |
| 35 | $CH_3$ | $C_4H_9-t$ | $CH_3$ | $SC_2H_5$ |
| 36 | $CH_3$ | $C_4H_9-t$ | $CH_3$ | $C_6H_5$ |

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. Nos. 4,695,288 or 4,737,416.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,717,712, 4,737,485 or 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,698,651, 4,695,287, 4,701,439, 4,757,046, 4,743,582, 4,769,360 or 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, cyan and a dye as described above of yellow hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner The following examples are provided to illustrate the invention.

EXAMPLE 1

Preparation of Compound 2

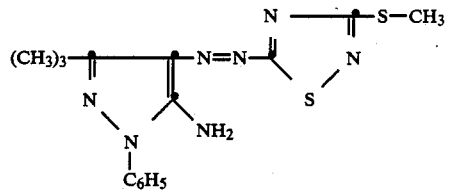

Preparation of the intermediate 5-amino-3-t-butyl-1-phenyl-pyrazole:

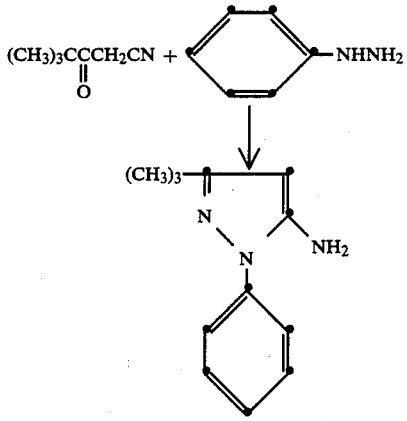

Pivaloyl acetonitrile (30.0 g; 0.24 mole) and ethanol (200 ml) were placed into a 500 ml round bottom flask. Phenylhydrazine (23.6 ml; 0.24 mole) was added with stirring followed by acetic acid (13.8 ml). The reaction was refluxed for 5 hours. Part of the ethanol was stripped off and the residue was poured into ice water. The product was filtered off and washed with water. The solid was dissolved in hot ethanol (100 ml), diluted with water, stirred, filtered, and washed with water. The yield of solid, m.p. 65°-7° C. was 46.3 g (90%).

Preparation of the dye:

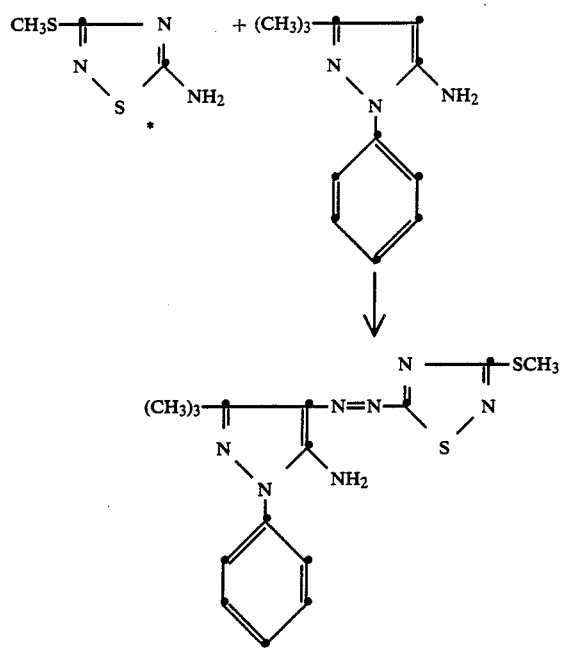

Sodium nitrite 0.72 g; 0.01 mole) was added to conc. sulfuric acid (5 ml), and dissolved with warming. The solution was cooled to <25° C., and 1:5 propionic acid-/acetic acid (10 ml) was added and cooled to 5° C. in an ice bath. The aminothiadiazole (1.47 g; 0.01 mole) was then added portionwise, keeping the temperature about 5° C. Another 10 ml of the mixed acid was added and the mixture was stirred for 2 hours.

The pyrazole coupler (2.15 g; 0.01 mole) was dissolved in 1:5 propionic acid/acetic acid (30 ml) with sodium acetate (6.8 g; 0.08 mole), cooled in an ice bath to 5° C., then the diazotized thiadiazole was added slowly, keeping the temperature around 5° C. The reaction mixture was stirred at room temperature overnight, diluted with water, and filtered.

The solid was dissolved in hot ethanol (80 ml), cooled, filtered, and oven dried to yield 1.93 g (52% yield) of purified dye (m.p. 224°-5° C.) (λ-max 448 nm).

EXAMPLE 2

Yellow Dye-Donor

A yellow dye-donor element was prepared by coating the following layers in the order recited on a 6 μm poly(ethylene terephthalate) support:

(1) Subbing layer of duPont Tyzor TBT ® titanium tetra-n-butoxide (0.16 g/m$^2$) coated from n-butyl alcohol, and (2) Dye layer containing the yellow dye identified in Table 1 below (0.47 mmoles/m$^2$), FC-431 ® surfactant (3M Corp.) (0.002 g/m$^2$), in a cellulose acetate-propionate (2.5% acetyl, 48% propionyl) binder (weight equal to 1.9× that of the dye) coated from a cyclopentanone, toluene, and methanol solvent mixture. A subbing and slipping layer were coated on the back side of the element similar to those disclosed in U.S. application Ser. No. 184,316 of Henzel et al, filed Apr. 21, 1988.

A dye-receiving element was prepared by coating a solution of Makrolon 5705 ® (Bayer AG Corporation) polycarbonate resin (2.9 g/m$^2$) in a methylene chloride and trichloroethylene solvent mixture on a titanium dioxide pigmented-polyethylene overcoated paper support.

The dye side of the dye-donor element strip approximately 3 cm×15 cm in area was placed in contact with the dye image-receiving layer of the dye-receiver element of the same area. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 3.1 mm/sec. Coincidentally, the resistive elements in the thermal print head were pulsed for discrete sequential intervals at per-pixel pulse widths from 0 up to 8 msec to generate a graduated-density image. The voltage supplied to the print head was approximately 22 v representing approximately 1.5 watts/dot (12 mjoules/dot) for maximum power.

The dye-receiving element was separated from the dye-donor element. The Status A blue reflection densities of each stepped image consisting of a series of 8 graduated density steps 1 cm×1 cm and the D-max were read. The images were then subjected to High-Intensity Daylight fading (HID-fading) for 7 days, 50 kLux, 5400° K., 32° C., approximately 25% RH and the densities were reread. The percent density loss was calculated from D-max. The following results were obtained:

TABLE 1

| Dye Donor Element w/ Compound | Status A Blue Density D max | % Loss After Fade |
|---|---|---|
| 1 | 1.3 | 2 |
| 2 | 1.2 | <1 |
| 22 | 1.3 | 2 |
| Control 1 | 1.1 | 31 |
| Control 2 | 1.2 | 29 |
| Control 3 | 0.8 | 43 |
| Control 4 | 1.7 | 55 |
| Control 5 | 1.4 | 47 |
| Control 6 | 1.6 | 23 |
| Control 7 | 1.0 | 68 |
| Control 10 | 1.2 | 14 |

The above results indicate that the dyes according to the invention have significantly improved light stability (lower % fade) in comparison to the Control dyes.

Control Compounds
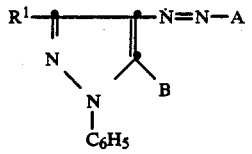
| | $R^1$ | A | B |
|---|---|---|---|
| Control Cmpd. 1 | $-CH_3$ | 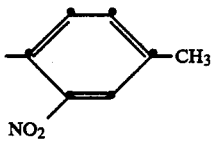 | $-NH_2$ |
| Control Cmpd. 2 | $-C(CH_3)_2$ | 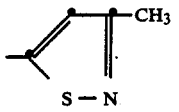 | $-NH_2$ |
| Control Cmpd. 3 | $-C(CH_3)_3$ | 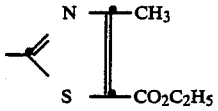 | $-NH_2$ |
| Control Cmpd. 4 | $-CH_3$ | 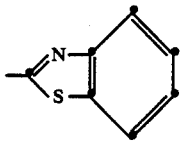 | $-NH_2$ |
| Control Cmpd. 5 | $-C(CH_3)_3$ | 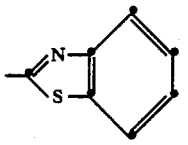 | $-NH_2$ |
| Control Cmpd. 6 | $-C(CH_3)_3$ | 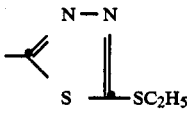 | $-NH_2$ |
| Control Cmpd. 7* | $-C(CH_3)_3$ | 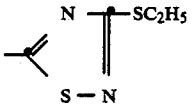 | $-N(CH_3)_3$ |
| (*The $-C_6H_5$ group is replaced by $-CH_3$) | | | |
| Control Cmpd. 8 | $CH_3$ | 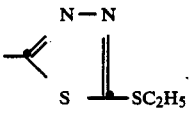 | 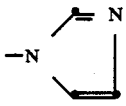 |
| Control Cmpd. 9 | $CH_3$ | 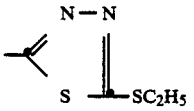 | 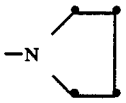 |

-continued

Control Compounds

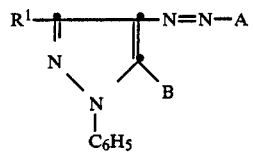

| | $R^1$ | A | B |
|---|---|---|---|
| Control Cmpd. 10 | 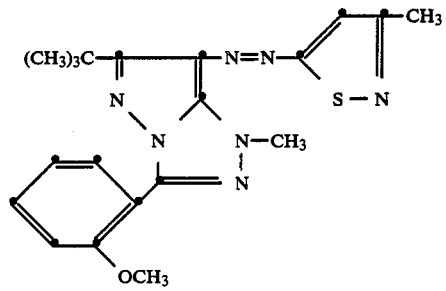 | | |

EXAMPLE 3

Yellow Dye-Donor

A yellow dye-donor element was prepared by coating the following layers in the order recited on a 6 μm poly(ethylene terephthalate) support:

(1) Subbing layer of duPont Tyzor TBT® titanium tetra-n-butoxide (0.16 g/m$^2$) coated from a n-butyl alcohol and n-propyl acetate solvent mixture, and (2) Dye layer containing the yellow dye identified in Table 2 below (0.93 mmoles/m$^2$), FC-431® surfactant (3M Corp.) (0.002 g/m$^2$), in a cellulose acetate-propionate (2.5% acetyl, 48% propionyl) binder (weight equal to 1.1× that of the dye) coated from a cyclopentanone, toluene, and methanol solvent mixture. A subbing and slipping layer were coated on the back side of the element similar to those disclosed in U.S. application Ser. No. 184,316 of Henzel et al, filed Apr. 21, 1988.

A dye-receiving element was prepared by coating a solution of Makrolon 5705® (Bayer AG Corporation) polycarbonate resin (2.9 g/m$^2$) and polycaprolactone (0.8 g/m$^2$) in methylene chloride on a titanium dioxide pigmented-polyethylene overcoated paper support.

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-133) (thermostatted at 26° C.) was pressed with a force of 8.0 pounds (3.6 kg) against the dye-donor element side of the assemblage pushing it against the rubber roller.

The imaging electronics were activated causing the assemblage to be drawn between the printing head and roller at 6.9 mm/sec. Coincidentally, the resistive elements in the thermal print head were pulsed at 19 mm μsec/pulse at 128 μsec intervals during the 33 msec/dot printing time. A stepped density image was generated by incrementally increasing the number of pulses/dot from 0 to 255. The voltage supplied to the print head was approximately 23.5 v representing an instantaneous peak power of 1.3 watts/dot and a maximum total energy of 9.6 mjoules/dot.

The dye-receiving element was separated from the dye-donor element. The Status A blue reflection densities of each stepped image consisting of a series of 11 graduated density steps 1 cm×1 cm and the D-max were read.

The images were then subjected to High-Intensity Daylight fading (HID-fading) for 7 days, 50 kLux, 5400° K., 32° C., approximately 25% RH and the densities were reread. The percent density loss was calculated from D-max. The following results were obtained:

TABLE 2

| Dye-Donor Element w/ Compound | Status A Blue Density D max | % Loss After Fade |
|---|---|---|
| Formula (I) Compound | | |
| 1 | 1.4 | <1 |
| 3 | 1.8 | 2 |
| 4 | 1.3 | 4 |
| 5 | 1.3 | 5 |
| 6 | 1.6 | 11 |
| 7 | 1.5 | 19 |
| 8 | 1.4 | <1 |
| 9 | 1.3 | <1 |
| Control 6 | 1.7 | 23 |
| Control 8 | 0.7 | 47 |
| Control 9 | 1.4 | 89 |
| Formula (II) Compound | | |
| 23 | 2.5 | <1 |
| 24 | 2.3 | <1 |
| 25 | 2.1 | <1 |
| 26 | 2.0 | <1 |
| 27 | 2.9 | <1 |
| 28 | 2.2 | 1 |
| 29 | 2.6 | 1 |
| 30 | 2.9 | 3 |
| 31 | 2.7 | 3 |
| 32 | 2.7 | 4 |
| 33 | 2.0 | 5 |
| 34 | 2.9 | 5 |
| 35 | 2.8 | 6 |
| 36 | 2.7 | 7 |
| Control 10 | 1.2 | 14 |

The above results indicate that the dyes according to the invention have significantly improved light stability (lower % fade) in comparison to the Control dyes.

The invention has been described in detail with particular reference to preferred embodiments thereof, but it will be understood that variations and modifications can be effected within the spirit and scope of the invention.

What is claimed is:

1. A yellow dye-donor element for thermal dye transfer comprising a support having thereon a dye dispersed in a polymeric binder, said dye having the formula:

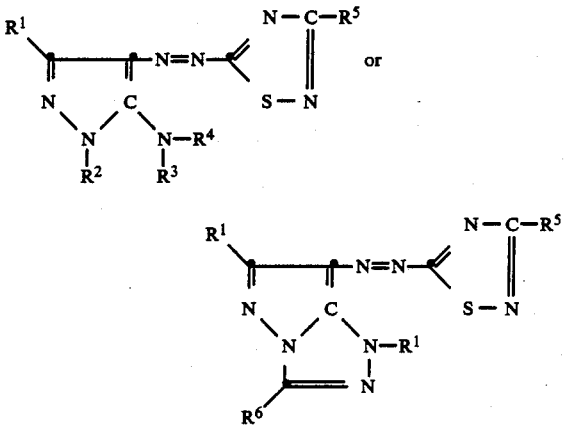

wherein each $R^1$ independently represents hydrogen, a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ and $R^4$ each independently represents $R^1$, with the proviso that at least one of $R^3$ and $R^4$ is hydrogen;

$R^5$ represents hydrogen; halogen; cyano; a substituted or unsubstituted alkyl, alkylthio, alkylsulfonyl, alkylsulfinyl, alkoxycarbonyl, carbamoyl or alkoxy group having from 1 to about 10 carbon atoms; a substituted or unsubstituted arylthio, arylsulfonyl, arylsulfinyl, aryloxy or aryl group having from about 6 to about 10 carbon atoms; or a substituted or unsubstituted acylamido group having from about 1 to about 7 carbon atoms; and $R^6$ represents hydrogen; halogen; cyano; alkoxy; a substituted or unsubstituted alkyl group having from 1 to about 10 carbon atoms; a cycloalkyl group having from about 5 to about 7 carbon atoms or an aryl group having from about 6 to about 10 carbon atoms.

2. The element of claim 1 wherein $R^1$ is hydrogen, methyl, ethyl, t-butyl, phenyl or benzyl.

3. The element of claim 1 wherein $R^2$ is phenyl.

4. The element of claim 1 wherein $R^3$ is hydrogen, methyl, butyl, phenyl or methoxyphenyl.

5. The element of claim 1 wherein $R^4$ is hydrogen.

6. The element of claim 1 wherein $R^5$ is hydrogen, phenyl or alkylthio.

7. The element of claim 1 wherein $R^6$ is methyl, t-butyl or i-propyl.

8. The element of claim 1 wherein said support comprises poly(ethylene terephthalate) and the side of the support opposite the side having thereon said dye layer is coated with a slipping layer comprising a lubricating material.

9. The element of claim 1 wherein said dye layer comprises sequential repeating areas of magenta, cyan and said yellow dye.

10. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye has the formula:

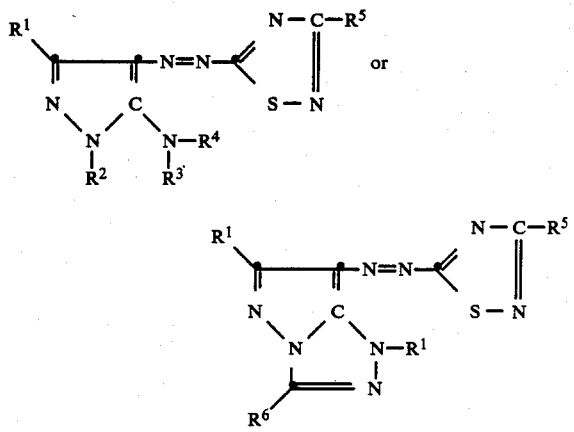

wherein each $R^1$ independently represents hydrogen, a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ and $R^4$ each independently represents $R^1$, with the proviso that at least one of $R^3$ and $R^4$ is hydrogen;

$R^5$ represents hydrogen; halogen; cyano; a substituted or unsubstituted alkyl, alkylthio, alkylsulfonyl, alkylsulfinyl, alkoxycarbonyl, carbamoyl or alkoxy group having from 1 to about 10 carbon atoms; a substituted or unsubstituted arylthio, arylsulfonyl, arylsulfinyl, aryloxy or aryl group having from about 6 to about 10 carbon atoms; or a substituted or unsubstituted acylamido group having from about 1 to about 7 carbon atoms; and $R^6$ represents hydrogen; halogen; cyano; alkoxy; a substituted or unsubstituted alkyl group having from 1 to about 1 0 carbon atoms; a cycloalkyl group having from about 5 to about 7 carbon atoms or an aryl group having from about 6 to about 10 carbon atoms.

11. The process of claim 10 wherein said support is poly(ethylene terephthalate) which is coated with sequential repeating areas of magenta, cyan and said yellow dye, and said process steps are sequentially performed for each color to obtain a three-color dye transfer image.

12. In a thermal dye transfer assemblage comprising:

(a) a dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye has the formula

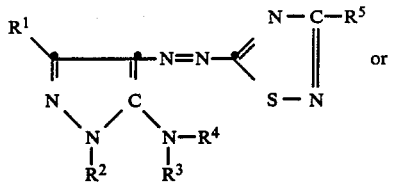

or

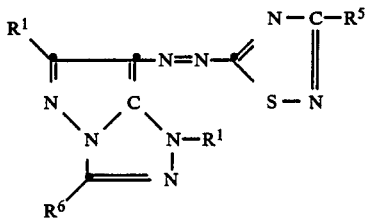

wherein each $R^1$ independently represents hydrogen, a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^3$ and $R^4$ each independently represents $R^1$, with the proviso that at least one of $R^3$ and $R^4$ is hydrogen;

$R^5$ represents hydrogen; halogen; cyano; a substituted or unsubstituted alkyl, alkylthio, alkylsulfonyl, alkylsulfinyl, alkoxycarbonyl, carbamoyl or alkoxy group having from 1 to about 10 carbon atoms; a substituted or unsubstituted arylthio, arylsulfonyl, arylsulfinyl, aryloxy or aryl group having from about 6 to about 10 carbon atoms; or a substituted or unsubstituted acylamido group having from about 1 to about 7 carbon atoms; and $R^6$ represents hydrogen; halogen; cyano; alkoxy; a substituted or unsubstituted alkyl group having from 1 to about 10 carbon atoms; a cycloalkyl group having from about 5 to about 7 carbon atoms or an aryl group having from about 6 to about 10 carbon atoms.

13. The assemblage of claim 12 wherein $R^1$ is hydrogen, methyl, ethyl, t-butyl, phenyl or benzyl.

14. The assemblage of claim 12 wherein $R^2$ is phenyl.

15. The assemblage of claim 12 wherein $R^3$ is hydrogen, methyl, butyl, phenyl or methoxyphenyl.

16. The assemblage of claim 12 wherein $R^4$ is hydrogen.

17. The assemblage of claim 12 wherein $R^5$ is hydrogen, phenyl or alkylthio.

18. The assemblage of claim 12 wherein $R^6$ is methyl, t-butyl or i-propyl.

* * * * *